United States Patent [19]

Sink

[11] Patent Number: 4,475,059

[45] Date of Patent: Oct. 2, 1984

[54] IMAGE INTENSIFIER TUBE WITH REDUCED VEILING GLARE AND METHOD OF MAKING SAME

[75] Inventor: Ronald A. Sink, Roanoke, Va.

[73] Assignee: International Telephone and Telegraph Corporation, New York, N.Y.

[21] Appl. No.: 383,863

[22] Filed: Jun. 1, 1982

[51] Int. Cl.[3] ..... H01J 43/22

[52] U.S. Cl. ..... 313/534; 313/532; 313/524; 350/276 SL

[58] Field of Search ..... 313/534, 533, 532, 527, 313/524, 544; 350/276 SL, 164

[56] References Cited

U.S. PATENT DOCUMENTS 3,039,349 6/1962 Rodgers ..... 350/276 SL 3,898,498 8/1975 Stone et al. ..... 313/534

4,295,073 10/1981 Freeman et al. ..... 313/534 X

FOREIGN PATENT DOCUMENTS 2104171 4/1972 France ..... 313/534

*Primary Examiner*—David K. Moore

*Assistant Examiner*—Vincent De Luca

*Attorney, Agent, or Firm*—John T. O'Halloran; Robert P. Seitter

[57] ABSTRACT

An image intensifier tube and a method of making same is disclosed wherein veiling glare caused by the amplification of off axis light is reduced. Included is a colored, low reflective, light absorbing layer formed in the face plate of the tube adjacent any surface at which off axis light could otherwise be reflected to the photoemissive device associated with the face plate.

12 Claims, 3 Drawing Figures

IMAGE INTENSIFIER TUBE WITH REDUCED VEILING GLARE AND METHOD OF MAKING SAME

BACKGROUND OF THE INVENTION

This invention relates to image intensifier tubes of the type used in night vision viewing systems and, more particularly, to an image intensifier tube with reduced veiling glare and also to a method of making same.

Image intensifier tubes multiply the amount of incident light they receive and thus provide an increase in light output which can be supplied either to a camera or directly to the eyes of a viewer. These devices are particularly useful for providing images from dark regions and have both industrial and military application. For example, these devices are used for enhancing the night vision of aviators, for photographing extraterrestrial bodies; and for providing night vision to sufferors of retinitis pigmentosa (night blindness).

Modern image intensifier tubes utilize a microchannel plate (oft times referred to as an MCP) which is a thin glass plate having an array of microscopic holes through it. Each hole is capable of acting as a channel-type secondary emission electron multiplier. When the micro-channel plate is placed in the plane of an electron image in an intensifier tube, one can achieve a gain of up to several thousand and extremely high resolution. Since each channel in a micro-channel plate operates nearly independently of all the others, a bright point source of light will saturate a few channels but will not spread out over adjacent areas. This characteristic of "local saturation" makes these tubes more immune to blooming at bright areas. However, these tubes suffer from a problem known as "veiling glare". Veiling glare is the result of scattered light falling on the light input or focal surface of the tube. In the image intensifier it results in a loss of contrast by filling in the darker portions of the image and decreasing the visibility of small or low contrast objects. In fact, in extreme cases it can cause a complete loss of picture information over a substantial part of the field of view.

Veiling glare is due primarily to off axis light which is reflected into the inside of the tube and is intensified to appear in the field of view as unwanted images. The sources of veiling glare emanate from bright light rays which are outside the normal field of view; and hence, light rays which are at angles off the axis of view. The light emanating from sources outside normal field of view is reflected by the tube to cause the unwanted veiling glare.

There have been various attempts to eliminate or reduce the veiling glare by adding material to the tube which absorbs off axis light and prevents it from being reflected to the inside of the tube. For example, black rings have been formed on the surface reflecting the off axis light; and these rings have been retained in place by sealing a glass ring to the surface or by fusing a glass ring to the surface to sandwich the ring in between the reflecting surface and the glass ring. This has been difficult to do and is very expensive. Another technique has been to etch a groove between the light input surface and the reflecting surface and to fill the groove with light absorbing material. This, too, has been difficult to do and is also very expensive.

It is, therefore, an object of the present invention to provide a light image intensifier tube with reduced veiling glare which is economical to make. It is a further object of this invention to provide a method of making such a tube in a highly economical and efficient manner.

SUMMARY OF THE INVENTION

An image intensifier tube is formed with a face plate made of optical material for transmitting light and with photoemissive means for emitting electrons in response to the light transmitted therethrough. In making the tube, there is included the step of forming a colored, low reflective, light absorbing layer of optical material in the face plate adjacent any surface from which off axis light could be reflected to the photoemissive means.

The tube so formed includes the face plate arranged to receive and transmit input light; the photoemissive means for emitting the electrons; and a micro-channel plate for amplifying the emitted electrons. The face plate also includes a surface where off axis input light could be reflected to the photoemissive means and the colored layer is formed adjacent that surface.

BRIEF DESCRIPTION OF THE DRAWINGS

In order to obtain a better understanding of the invention, reference is made to the following detailed description of a preferred embodiment thereof, in which.

DETAILED DESCRIPTION OF THE INVENTION

Figure 1:
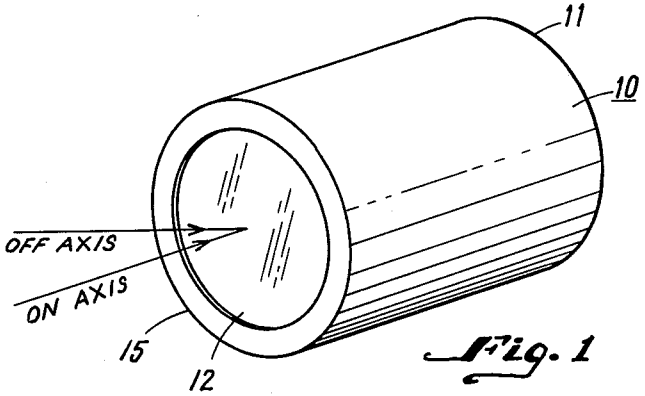
FIG. 1 is a perspective plan view of an image intensifier tube.

In FIG. 1, there is shown a simplified perspective view of an image intensifier tube 10. The image intensifier tube 10 includes a cylindrical housing 11 in which is located a front face plate 12 made of optical material which is arranged to receive and transmit light. The face plate 12 is normally sealed within the housing 11 and is surrounded by a peripheral flange 15. Light rays from the field of view (labeled on axis in FIG. 1) penetrate the face plate 12 and are directed to the electronics of the image intensifier where they are increased in amplitude. Light which emanates from outside the field of view (labeled off axis in FIG. 1) are reflected off an inner surface of the tube 10 and are directed back to the electronics where they are also increased in amplitude. This off axis light is the source of the veiling glare, as will be made clear hereinafter.

Figure 2:
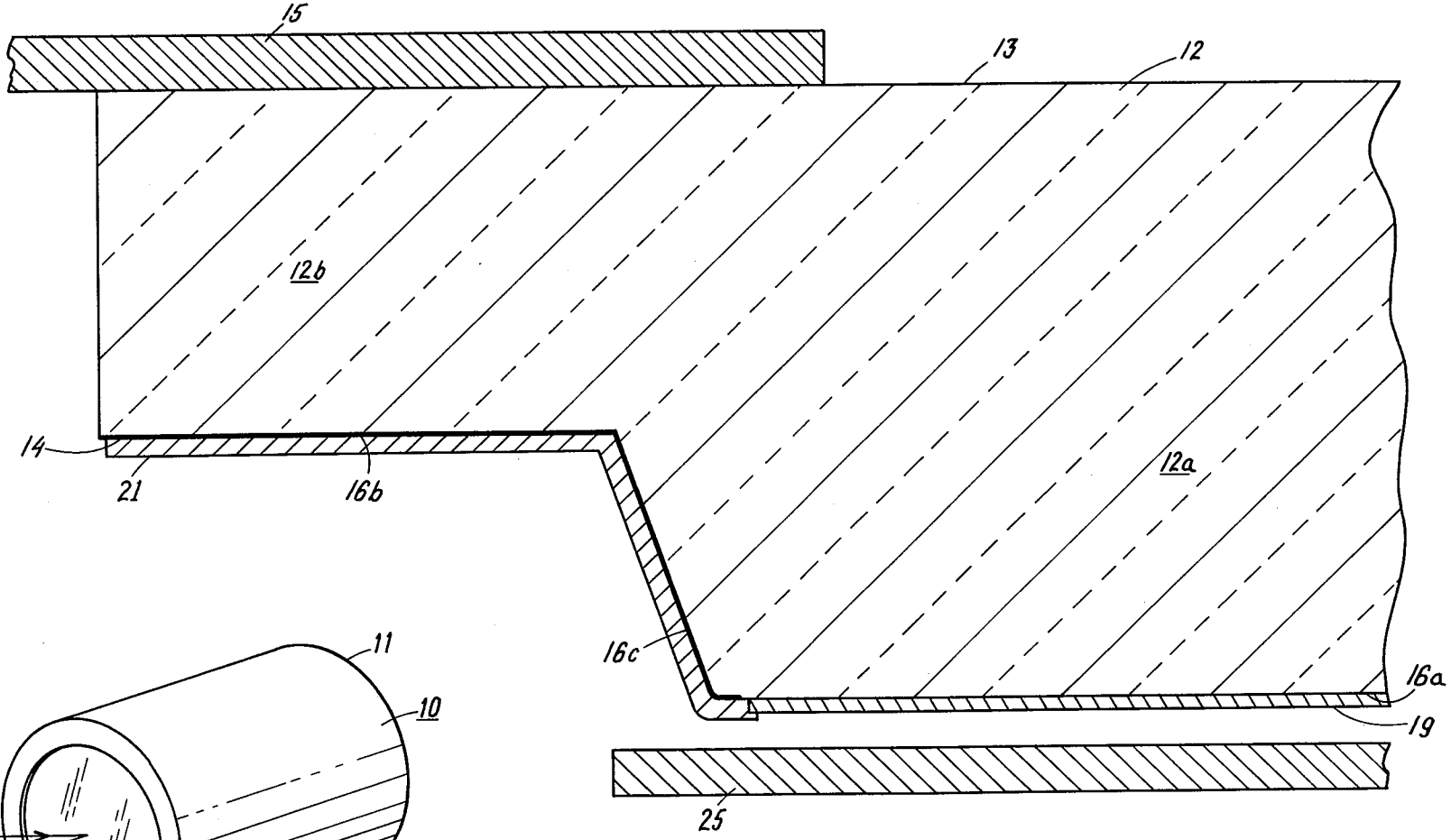
FIG. 2 is a cross-sectional view of a glass face plate usable in the image intensifier tube in accordance with this invention; and, FIG. 3 is a partial cross-sectional view of a typical intensifier tube in accordance with this invention.

In Fig. 2, the image intensifier tube 10 can be seen to comprise three basic components; the face plate 12 which functions as a cathode; a face plate (inside a chamber 18 and not illustrated in the drawing) which functions as an anode; and a micro-channel plate 25 located in between and spaced from both the face plate 12 and the chamber 18. Both the cathode and anode face plates are preferably formed from glass of high optical quality. The micro-channel plate is also formed of a glass material which possesses a secondary emissive property and conductive characteristics. The micro-channel plate is mounted in the image tube with both its input and output faces parallel to the image tube cathode face plate 12 and a phosphorous screen associated with the anode face plate. The micro-channel plate operates to amplify photo electrons generated by the input light in order to increase the light output of the tubes.

The face plate 12 can be made of a clear, high quality optical glass such as Corning 7056. This glass comprises 70 percent silica ($S_iO_2$), 17 percent boric oxide ($B_2O_3$), 8 percent potash ($K_2O$), 3 percent alumina ($Al_2O_3$) and 1 percent each of soda ($Na_2O$) and lithium oxide ($Li_2O$). Other glasses may, of course, be used. In shape, the face plate 12 includes a central, generally circular body portion 12*a* and a reduced thickness sill portion 12*b* in the form of a flange surrounding the body portion. One surface 13 of the face plate 12 extends continuously across the body and sill portions 12*a* and 12*b*, respectively, and the portion of this surface extending over the sill portion 12*b* and a small adjacent portion of the central body portion 12*a* fits under the flange 15 and is secured thereto to retain the face plate in the housing 11. The remainder of the portion of surface 13, that is, that portion surrounded by the flange 15 is the exposed surface of the face plate 12 on which input light impinges.

The face plate 12 also includes surface portions 16*a* and 16*b* which are generally parallel to surface 13 and which extend over the body portion 12*a* and sill portion 12*b*, respectively. Because of the difference in thickness between the body portion 12*a* and the sill portion 12*b*, the surface portions 16*a* and 16*b* lie in different planes with the portion 16*a* being spaced farther from the surface 13 than is the portion 16*b*. Extending between the surface portions 16*a* and 16*b* is a connecting surface portion 16*c* which, in the embodiment disclosed herein, is generally frusto-conical.

As is usual in the art, surface portion 16*a* is coated with a photoemissive wafer 19 formed so that light impinging on the exposed portion of surface 13 and eventually striking the wafer 19 causes the emission of electrons. These electrons are accelerated across a gap by an electric field to the MCP 25 causing the secondary emission of electrons all in accordance with known principles. The usual photoemissive wafer is a suitable gallium arsenide (GaAs) device, but other suitable materials can be used. Connecting the photoemissive material 19 to an external biasing power supply (not shown) is a coating of conductive material 21 applied to the surfaces 16*b* and 16*c* and also over a portion of surface 16*a* so that this coating makes contact with the wafer 19. The most usual way of applying the coating 21 is to evaporate a metal, e.g., Inconel, on these surfaces by conventional techniques.

While the metal conductive coatings 19 are most satisfactory, they are in fact a major cause of the veiling glare. Off axis light impinging on the exposed portion of surface 13 strikes this metal and is reflected back into the central body portion where it impinges on the photoemissive material 19 causing the emission of electrons which are accelerated to the MCP 25 causing secondary emission of electrons. Since the MCP 25 causes an increase in light output, it actually enhances the undesirable veiling glare.

In order to reduce veiling glare, this invention utilizes a stain that is fired into the face plate glass adjacent the reflecting surfaces. Fusing the stain into the glass converts a layer of the clear optical glass adjacent the reflecting surface into a colored low reflective, light absorbing glass as shown at 14 in the drawing. The stain is such that it forms a metallic oxide in the glass that provides the coloration of the layer 14. The layer 14 absorbs off axis light and prevents it from being reflected to the photoemissive wafer 19. Thus, the off axis light does not cause the emission of electrons which migrate to the MCP 25 to produce the veiling glare.

A preferred metallic oxide layer 14 is silver oxide (Ag O) which can be formed from an amber stain including small amounts of silver. One example of such a stain is Amber Dip Stain No. 657 manufactured by American Ceramics Lab of Woodbridge, N.J. The layer 14 is preferably formed before the photoemissive wafer 19 and the conductive coating 21 are provided. This is accomplished by coating the connecting surface portion 16*c* and, preferably, also the surface portion 16*b* with the amber stain. Thereafter, the face plate 12 is heated conveniently, in an oven, in an oxidizing atmosphere, e.g., air, to a temperature of between about 530° C. to about 590° C. This temperature is maintained for about six to seven hours.

By heating the coated plate in the manner described above, silver ions are formed in the stain and sodium ions are formed in the glass and an ion exchange occurs. Thus, the silver ions migrate into the glass and the sodium ions migrate into the amber stain. The silver ions combine with the oxygen in the glass forming black or red-black light absorbing silver oxide layer 14 approximately 30 to 100 microns deep. This layer absorbs the off axis light so that it does not reflect to the MCP 25. The coated plate is allowed to cool and is then removed from the oven. The resin and sodium residue is then scraped from the surface portions 16*b* and 16*c* and the plate is then cleaned and processed in accordance with conventional techniques to provide the photoemissive wafer 19 and conductive material 21.

It has been determined that fusing the stain at the indicated temperatures for a time less than six hours will not effect the necessary coloration and that firing for more than seven hours will not effect any significant further coloration. If, after seven hours the coloration is not deemed dark enough, the surface portions 16*b* and 16*c* are again coated with the amber stain and refired as described above. By repeating the process, the color of layer 14 is darkened.

Various stains can be utilized to form the colored layer. It has been found, however, that stains including large amounts of copper should be avoided when using gallium arsenide photoemissive wafers. An excessive amount of copper degrades the gallium arsenide and detracts from its performance.

Figure 3:
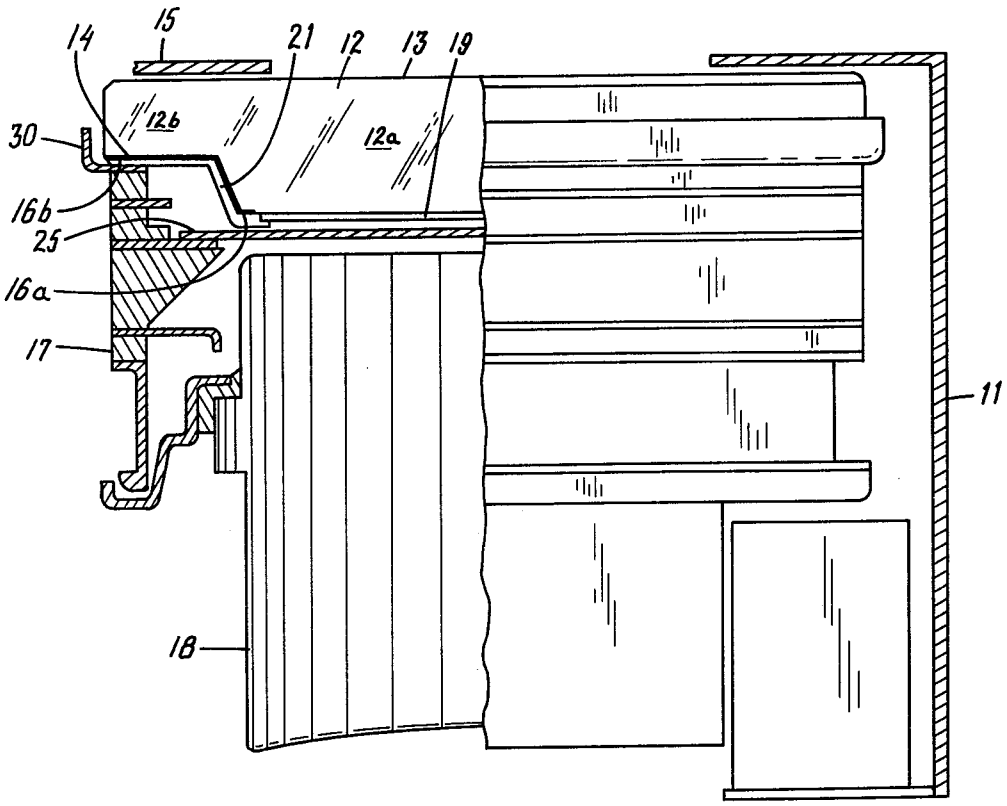

Referring to FIG. 3, the image intensifier tube 10 is shown in greater detail. As seen, the flange 15 is part of the cylindrical body 11 and the face plate 12 underlies the flange 15 and is supported at its ends by two "L" shaped members such as 30. The central body portion 12*a* is about 0.22" while the sill 12*b* is about 0.15".

Located beneath the face plate 12 is the MCP plate 25. Both plates as 12 and 25 are sealed to the tube body 17 by means of conventional supporting structures. The chamber 18 contains the anode fiber optic face plate and the remaining structures forming the image intensifier tube. Essentially, the entire tube from top to bottom is approximately 1¼" in length with a typical diameter of 1.4" and hence as one can ascertain, the entire unit is extremely small.

While in the foregoing, there has been described a preferred embodiment of the invention, it should be understood that various changes and modifications can be made without departing from the true spirit and scope of the invention.

I claim:

1. An image intensifier tube including a face plate formed of optical material for receiving and transmitting input light, said face plate including photoemissive means for emitting electrons in response to the input light; and a micro-channel plate for amplifying the electrons emitted from said photoemissive means; said face plate including a surface where off axis input light could be reflected to said photoemissive means causing electron emission resulting in veiling glare; a layer of colored light absorbing material formed in said face plate and extending inwardly from said surface.

2. An image intensifier tube in accordance with claim 1 wherein said layer includes a metallic oxide fired into said face plate.

3. An image intensifier tube in accordance with claims 1 or 2 wherein said layer includes silver oxide.

4. An image intensifier in accordance with claim 3 wherein said photoemissive means is a gallium arsenide wafer.

5. An image intensifier tube in accordance with claim 1 wherein said layer extends about 30 to about 100 microns inwardly from said surface.

6. An image intensifier in accordance with claims 1 or 2 wherein said photoemissive means is a gallium arsenide wafer and wherein said layer does not include a significant amount of copper.

7. A method of making an image intensifier tube including a face plate made of optical material for transmitting light and photoemissive means associated with the face plate for emitting electrons in response to light transmitted through said face plate, said method comprising:

forming a colored, low reflective, light absorbing layer of optical material in said face plate adjacent any surface from which off axis light could be reflected to said photoemissive means.

8. A method in accordance with claim 7 wherein said layer is formed by firing a stain into said optical material.

9. A method in accordance with claim 7 wherein said layer is formed by coating said any surface with a stain and heating said face plate to fire metal into said optical material.

10. A method in accordance with claim 7 wherein said layer is formed by coating said any surface with stain containing a metal element and heating said coated face plate.

11. A method in accordance with claim 10 wherein said coated face plate is heated in an oxidizing atmosphere for a period of time sufficient to form an oxide of said metal element in said optical material.

12. A method in accordance with claim 7 wherein said layer is formed by coating said any surface with a stain including silver, heating said coated face plate to a temperature of between about 530° C. to about 590° C. for a period of about six to seven hours.

* * * * *